US005472261A

United States Patent [19]

Oplenskdal et al.

[11] Patent Number: 5,472,261

[45] Date of Patent: Dec. 5, 1995

[54] ARRANGEMENT IN A RECLINE CHAIR

[76] Inventors: Olav Oplenskdal, N-6230, Sykkylven; Arve Ekornes, N-6222; Jostein Ekornes, N-6222, both of Ikornnes, all of Norway

[21] Appl. No.: 39,168

[22] PCT Filed: Sep. 25, 1991

[86] PCT No.: PCT/NO91/00124

§ 371 Date: Apr. 12, 1993

§ 102(e) Date: Apr. 12, 1993

[87] PCT Pub. No.: WO92/06621

PCT Pub. Date: Apr. 30, 1992

[30] Foreign Application Priority Data

Oct. 12, 1990 [NO] Norway ..... 904424

[51] Int. Cl.[6] ..... A47C 1/032

[52] U.S. Cl. ..... 297/342; 297/384.4

[58] Field of Search ..... 297/340–342, 297/317, 318, 284.1, 284.4, 284.8

[56] References Cited

U.S. PATENT DOCUMENTS

| | | | |
|---|---|---|---|
| 3,269,767 | 8/1966 | Marzocchi | 297/342 X |
| 4,040,661 | 8/1977 | Hogan et al. . | |
| 4,251,107 | 2/1981 | Sato | 297/318 X |
| 4,380,352 | 4/1983 | Diffrient . | |
| 4,452,486 | 6/1984 | Zapf et al. | 297/341 X |
| 4,830,429 | 5/1989 | Petitjean | 297/284.4 |
| 4,966,413 | 10/1990 | Palarski . | |

FOREIGN PATENT DOCUMENTS

| | | | |
|---|---|---|---|
| 164267 | 6/1985 | European Pat. Off. . | |
| 240389 | 3/1987 | European Pat. Off. . | |
| 1094123 | 5/1955 | France | 297/342 |
| 0056925 | 8/1890 | Germany | 297/341 |
| 149337 | 10/1979 | Norway . | |

*Primary Examiner*—Kenneth J. Dorner
*Assistant Examiner*—Milton Nelson, Jr.
*Attorney, Agent, or Firm*—Jenkens & Gilchrist

[57] ABSTRACT

An arrangement in a chair (1), having an adjustable chair back (2) and a neck support (3), characterized in that the arrangement comprises a device (12, 15) which influences the shape of the chair back (2) in dependence of the inclination of the chair back (2). The chair provides a pronounced support for the user's lower back when the chair back (2) is in an erected sitting position, whereas the device (12, 15) renders a gradually decreasing support of the user's lower back when said chair back (2) is lowered rearwardly towards a lying position. The lumbar region support (6) co-operates with a system for regulating the neck support (3) and the return thereof to a normal position each time the chair back (2) arrives at an extreme upper or lower position.

14 Claims, 9 Drawing Sheets

FIG. 7B
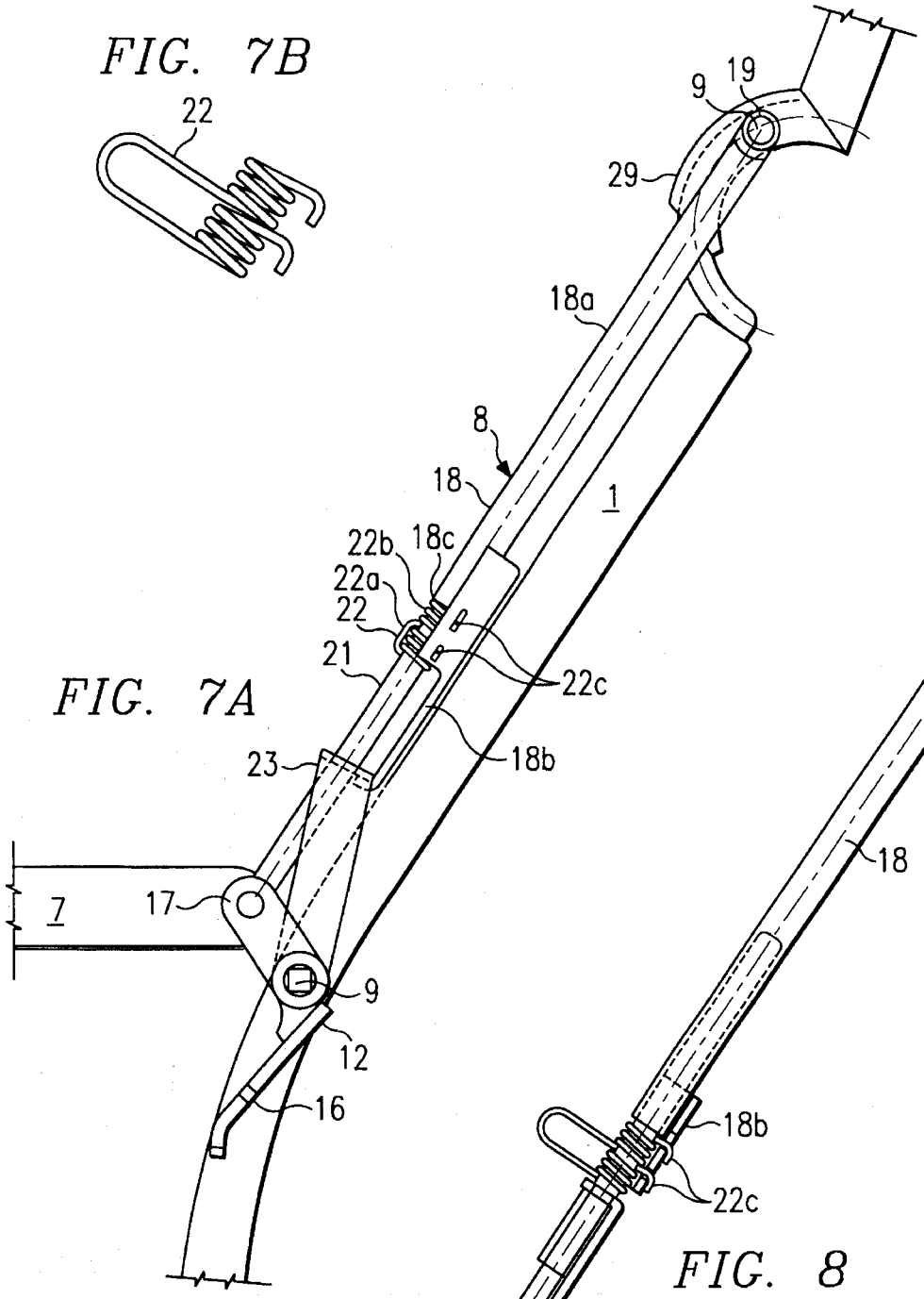
FIG. 7A
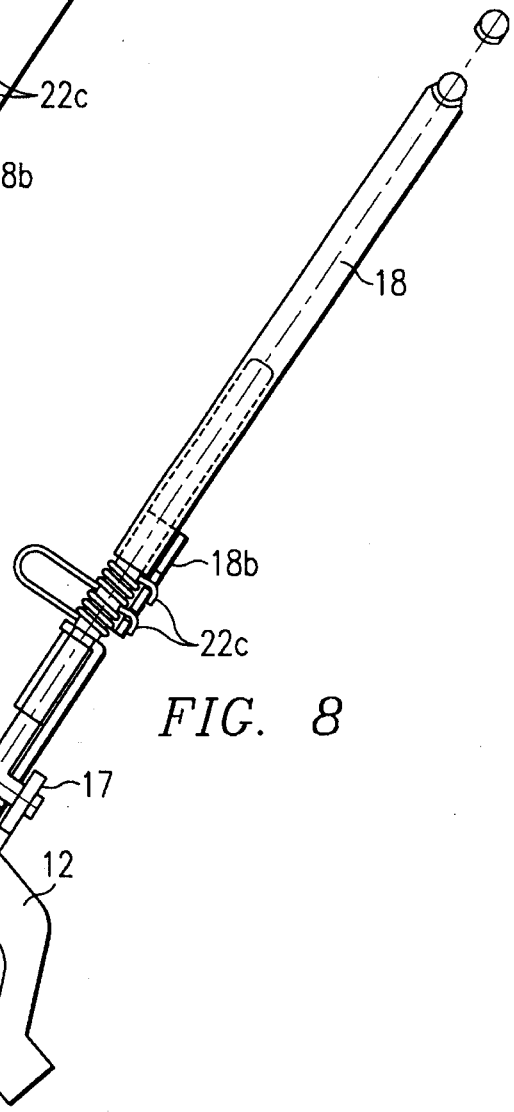
FIG. 8

FIG. 10C
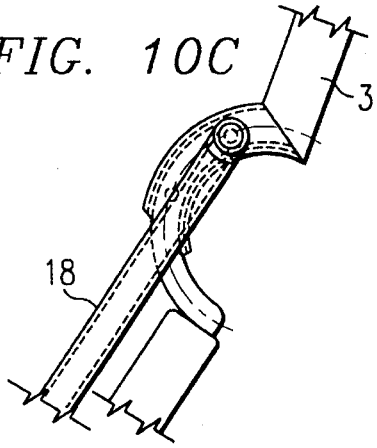
FIG. 10A
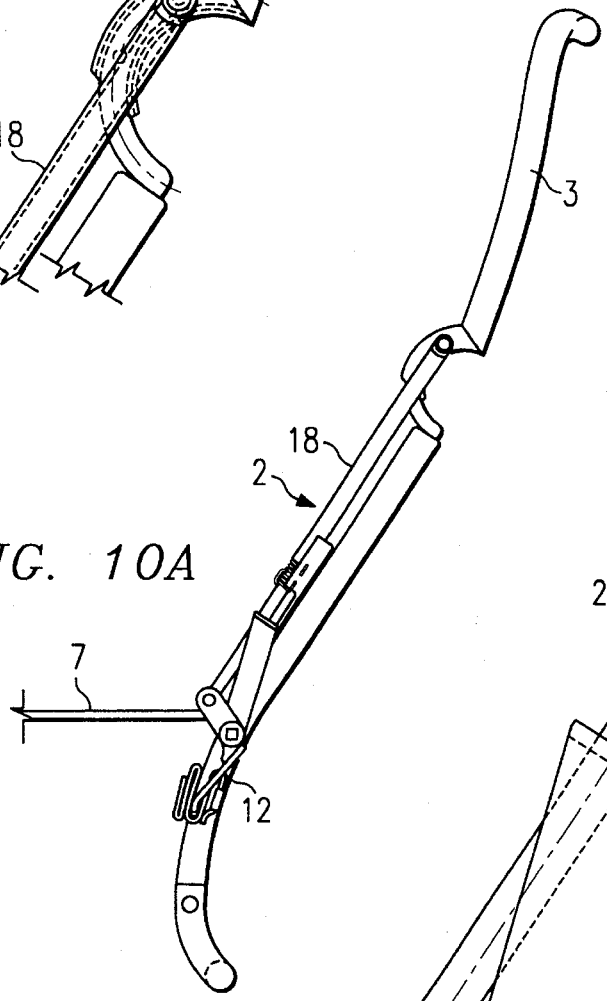
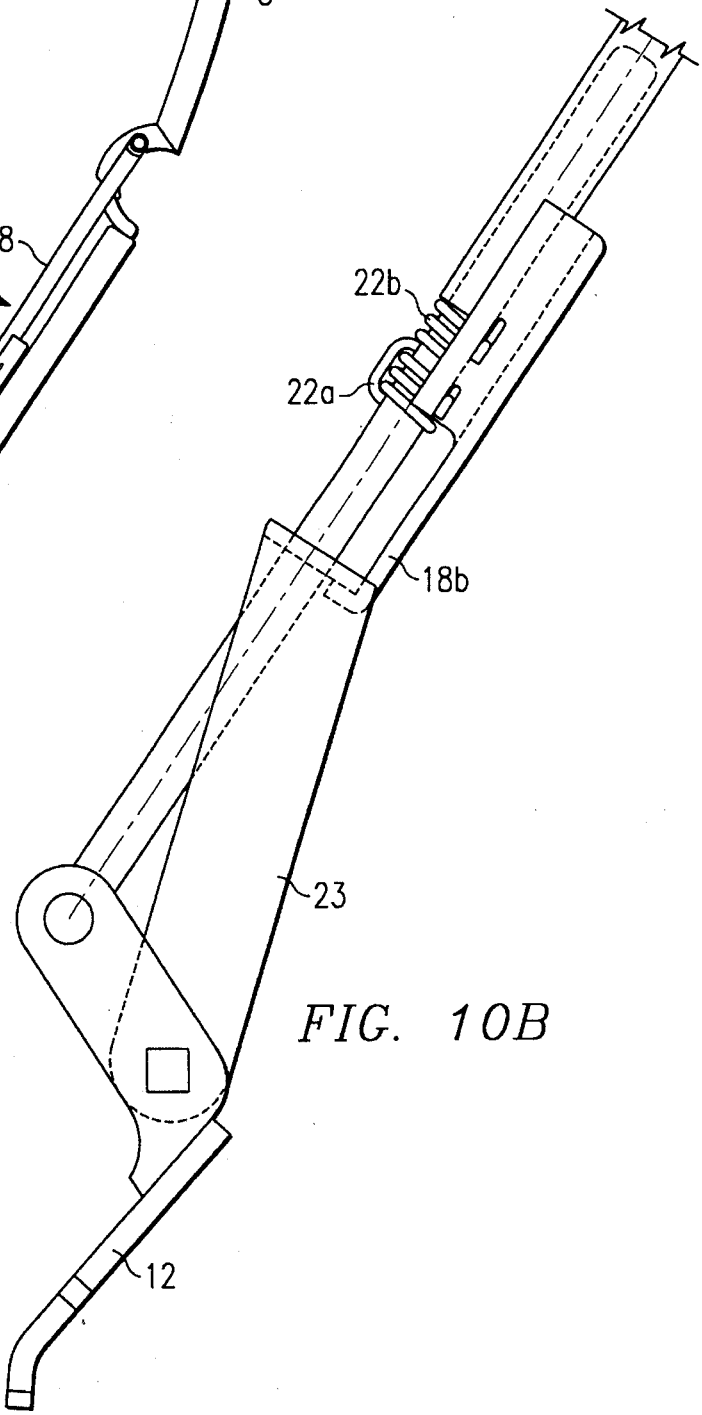
FIG. 10B
FIG. 10D
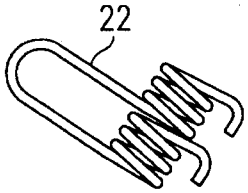

ARRANGEMENT IN A RECLINE CHAIR

FIELD OF THE INVENTION

The present invention relates to an arrangement in a recline chair, especially a recline chair having an adjustable back support in relation to the chair seat and a neck support.

BACKGROUND OF THE INVENTION

There are a plurality of different recline chairs which by means of various mechanisms can be converted from a sitting position to a lying position.

Typical features in these chairs include a link connection between the seat and the chair back, and in some chairs the chair back can be pivoted about an axis through the pivot points between the seat and chair back. In many chairs for home use the chair back pivots about a horizontal axis which is located somewhat higher up on the chair back, for example at level with the elbow of the user when she or he is sitting in an erected position in the chair.

PRIOR ART

From EP 0 164 367 there is known a recline chair including a chair back which is equipped with a shell on which the back cushioning itself is provided. However, no instructions are given therein that the shell and the corresponding cushioning should be allowed to alter in accordance with the various inclined positions of the chair back. This publication is mostly concerned with a neck support which by means of an arced extension arm can be brought to various inclined positions in relation to the chair back, namely by means of actuators, i.e. means which are provided below the seat and extended through the chair back.

EP 0 240 389 relates to a recline chair comprising a chair back including three elements, and due to link mechanisms between the various elements, the chair back will have its profile altered when being adjusted from an erected sitting position to a rearwardly inclined resting position. However, the three elements making up the known chair back will result in an "open" chair back, i.e. with openings or slits between the various elements, which will result in a restricted number of designs, and will depart from the principle of retaining a "whole" chair back with associated neck support.

U.S. Pat. No. 4,380,352 relates to a recline chair comprising a seat including a rearward portion pivoted for reclining of the chair and a chair back having an upper portion linked to the seat for pivotal motion therewith. This prior art chair has a fixed angle between the major area of the seat and the major area of the chair back. Thus, the area proving support for the user's lower back is constant in all positions of the chair, said publication therefore giving no instructions for the type of chair aimed for according to the present invention.

U.S. Pat. No. 4,966,413 relates to an articulated relaxation chair, in which a lumbar support member can be installed in the area of the chair back, but this lumbar support member is expanded or inflated by means of a fluid, and then by means of a switch or button on a control panel included in one of the arm rests of the chair. This previously known recline chair will thus provide a manual adjustment of the shape of the chair back, i.e. by means of manually operated elements, such that the user of the chair can adjust the support of the lumbar region according to his own wish. A disadvantage encountered by this solution is that when the user alters the inclination of the chair back, there will be a need for another adjustment of the lumbar region support.

NO 149 339 discloses an arrangement in an adjustable back and neck support for a sitting and/or bed furniture, wherein is provided an articulated back member which is adapted so that a person which is sitting in or lying on the furniture may exercise a pressure against the back support for thereby pivoting the neck support forwardly, for thereby allowing the user to take a more erected sitting position. However, this linked or articulated mechanism will not involve an alternation of the angular position of the back support, let alone the profile thereof in the lumbar support region.

BRIEF DISCLOSURE OF THE INVENTION

An object of the present invention is to provide a chair, especially a recline chair adapted for giving a pronounced support for the user's lower back when the chair back is in an erected sitting position, whereas the support of the user's lower back will be gradually decreased when the chair back is lowered rearwardly towards a lying position.

Another object of the present invention is to provide a recline chair in which the neck or head support will change in relation to the back support, such that when the chair back is lowered to a lying position, the neck support should be pivoted in the opposite direction so as to lift the head or the neck to a position which is comfortable for the user when reading or watching TV.

Still another object of the present invention is to provide a chair in which the shape of the chair back will be subjected to an alternation even if the variations of the angular position of the chair back is small.

Yet another object of the present invention is to provide a recline chair in which the support of the user's lower back is really pronounced when the chair back is in the fully upright position allowing for an erect sitting position of the user, and which chair should also be comfortable in all other angular positions of the chair back until the latter is fully laid down in an approximate horizontal position.

Still another object of the present invention is to provide means influencing the shape of the chair back automatically, i.e. without the use of manually operated levers or push buttons.

Another object of the present invention is to provide an individual pre-adjustment of the support for the user's lower back.

A still further object of the invention is to provide a chair allowing for a possible manual correction of the position of the neck support which correction should preferably be allowed in addition to an automatic return of the neck support to its normal position.

A still further object of the present invention is to provide a chair in which the support for the user's lower back will be varied within a large range of angular positions of the chair back, thereby providing a more comfortable recline chair.

The above objects are achieved in a chair of the type as stated in the preamble, which chair according to the present invention is characterized in that the chair arrangement comprises means influencing the shape of the chair back, especially in the area providing support for the user's lower back, in dependence of the chair back inclination.

A further feature of the present arrangement is that the means influencing the shape of the chair back are adapted for giving a pronounced support of the user's lower back when the chair back is in an erected sitting position, whereas said means render a gradually decreasing support of the user's lower back when said chair back is lowered rearwardly towards a lying position.

Further features of the present arrangement is to the fact that said means influencing the shape of the chair back can be made dependent upon the inclination of the chair back in relation to the arm rests of the chair or in relation to the frame of the chair.

Further features and advantages in the present arrangement will appear from the following description taking in conjunction with the appending drawings.

BRIEF DISCLOSURE OF THE DRAWINGS

FIGS. 7A and 7B illustrate further details of the regulating mechanism illustrated in FIG. 6, as seen in side view.

FIG. 8 illustrates the mechanism according to FIG. 7 in a front view.

FIGS. 10A, 10B, 10C, 10D, and 11A, 11B and 11C illustrate the mechanisms when the chair back takes the same inclination, but with different extreme positions of the neck support.

Figure 12C:
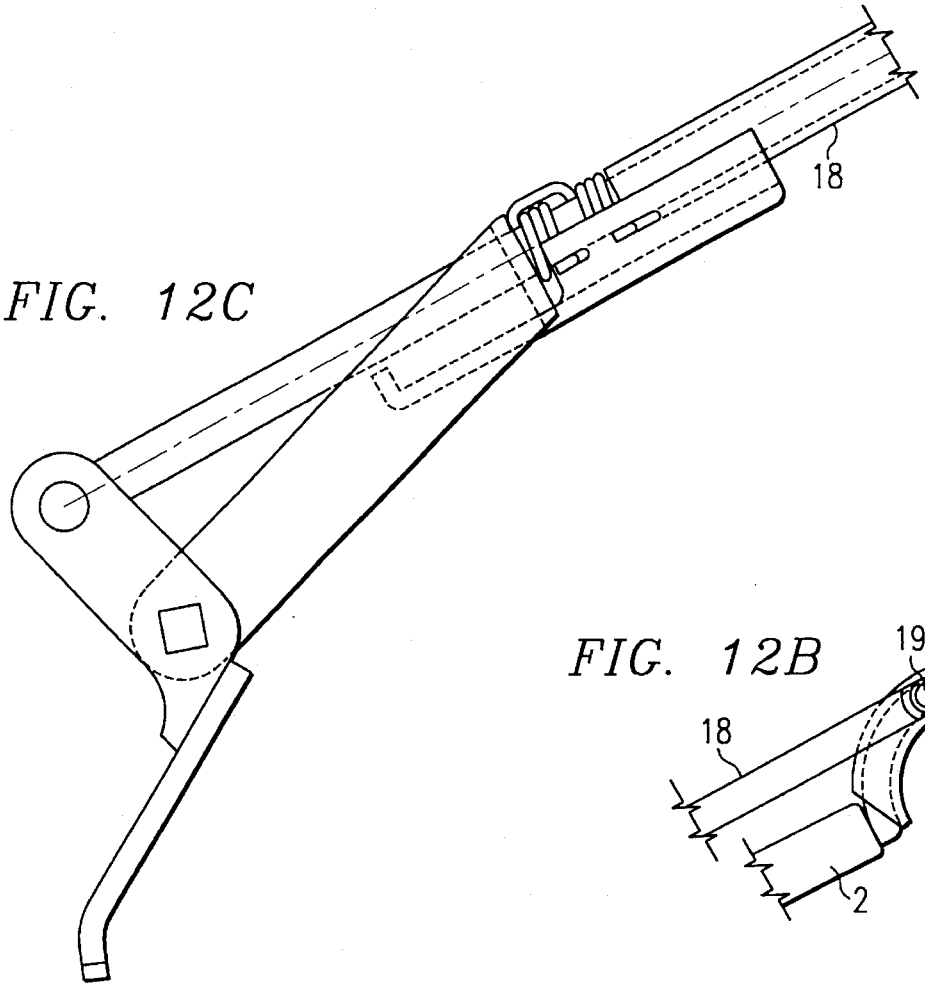
Figure 12B:
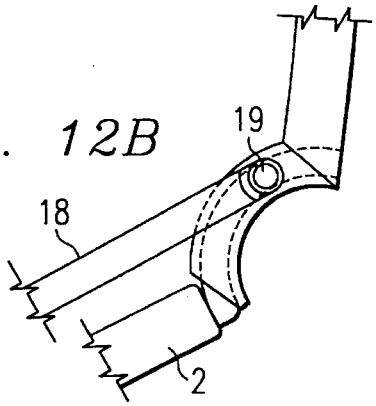
Figure 12A:
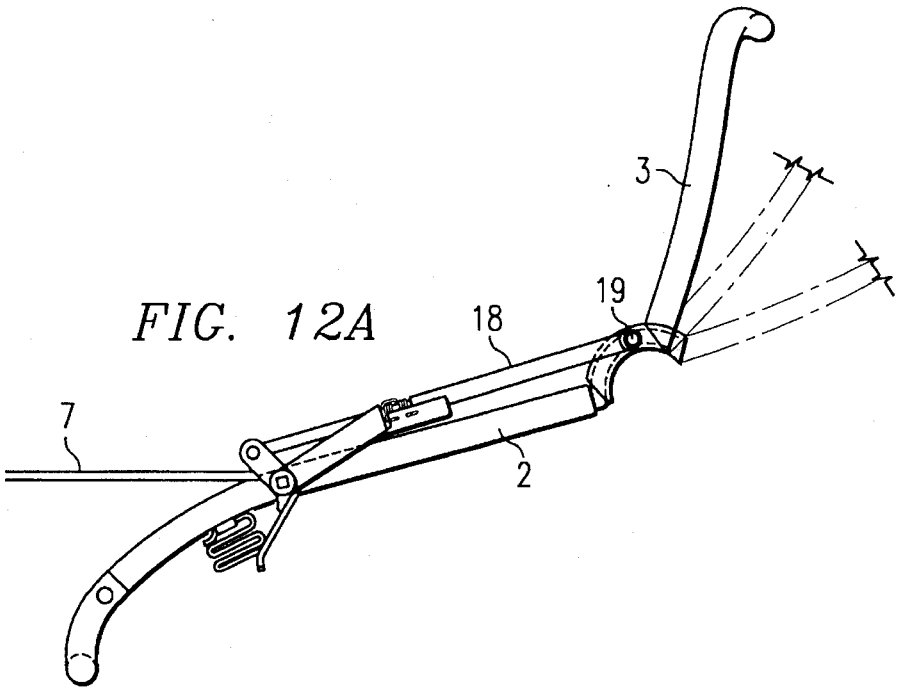

FIGS. 12A, 12B, and 12C illustrate the chair back in fully lowered position, but with the neck support in erected position and the support for the user's lower back in fully retracted position.

DETAILED DESCRIPTION OF EMBODIMENTS

Figure 1:
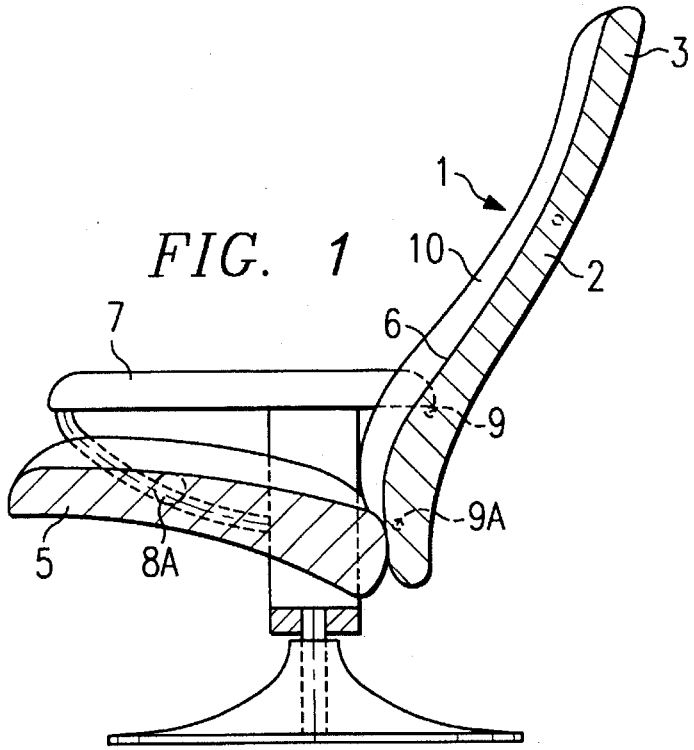
FIGS. 1–3 illustrate schematically the differences between an ordinary recline chair and a chair according to the present invention including an adjustable chair back according to the invention.
Figure 2:
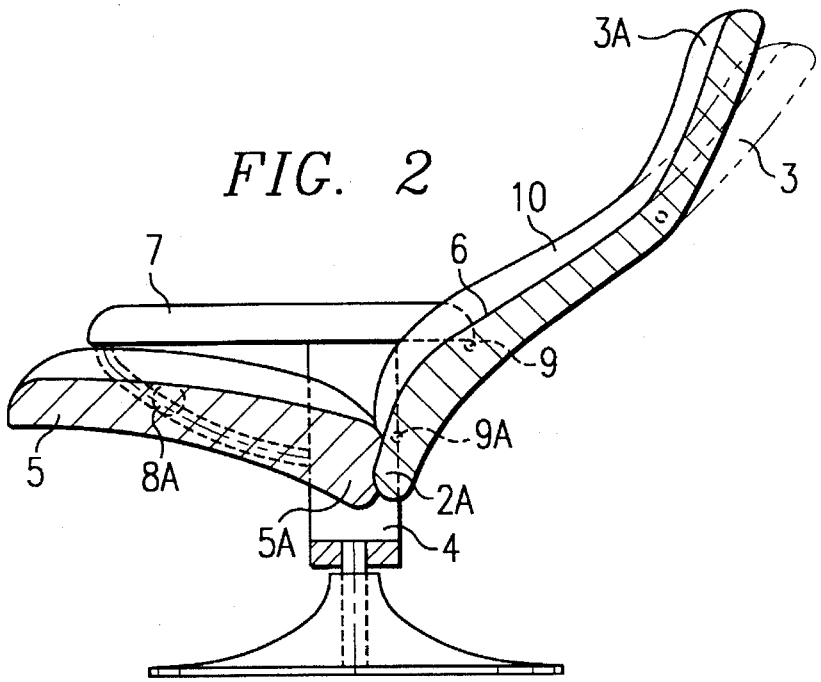
Figure 3:
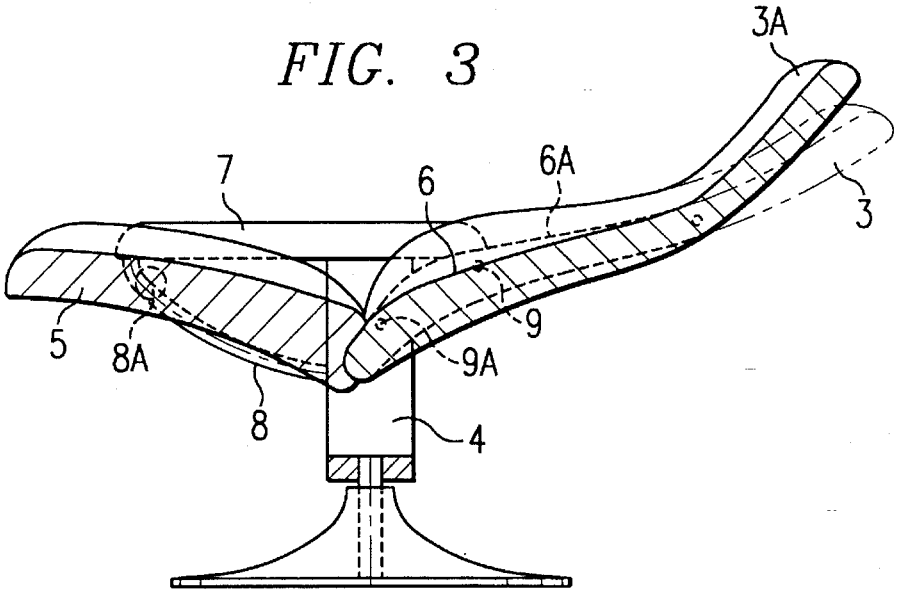

In FIGS. 1–3 which illustrate the general idea behind the present invention, there is generally indicated a chair by reference numeral 1, having an adjustable chair back 2 including an adjustable neck support 3. The chair back 2 is appropriately pivoted about a pivot point 9 which is fixed in relation to the frame 4, see FIG. 4 of the chair 1, so as to allow various inclined positions in relation thereto. It should be understood that the various inclined positions of the chair back 2 will influence not only the position of the chair seat 5, which will be shifted forth and back in relation to the chair frame 4, but also influence the shape of the chair back 2, especially in the area proving support for the user's lower back, here designated by reference numeral 6, respectively.

The chair 1 also includes a pair of arm rests, here indicated with reference numeral 7, as a simplified line in FIG. 1 and FIG. 2, but in fully solid lines in FIG. 3.

In FIG. 3 there is also indicated a sliding mechanism 8 including a hand operated tightening wheel 8A allowing for bringing the present embodiment of a recline chair to the various relative positions between the chair back 2 and the chair seat 5, and it is to be understood that this sliding mechanism 8 belongs to the prior art and will not be discussed in further details here.

The present invention finds specific application in connection with recline chairs comprising a chair back 2 having its pivoting point 9 approximately at level with the user's elbow, or at level with the rear portion of the arm rests 7 as illustrated in FIGS. 1–3. However, it should be noted that the present invention also finds application in connection with such recline chairs having a chair back with a pivoting point or pivoting axis at a level which is below the level of the arm rests, for example at the level of the connection link 9A between the chair back 2 and chair seat 5, which in the present embodiment is a pure connection link 9A moving relative to the chair frame 4 when various inclination angles are taken by the chair back 2.

More specifically, in FIG. 1 the support for the user's lower back 6 is illustrated with a solid line as the chair back 3 takes an upright position, and this lumbar region support 6 is here pressed forward to give a pronounced support for the user's lower back when he is sitting in an erect position. It is to be understood that outside this lumbar region support 6 there are provided cushioning 10 of a soft material as usual for these types of recline chairs. In this upright position as illustrated in FIG. 1, the neck support 3 constitutes a natural elongation of the main portions of the chair back 2.

In FIG. 2 which illustrates the chair back 2 in a half-lowered position, there is shown so to say no alternation in the lumbar region support 6, but the neck support 3A, here illustrated in solid lines, has been pivoted in the opposite direction, so as to give the user's head or neck a pronounced support for the latter to have a comfortable reading position or a comfortable position for watching TV.

However, in FIG. 3 illustrating the chair back 2 in a fully lowered position, i.e. allowing for a lying position of the user, the lumbar region support 6 has been removed for thereby reducing the support of the user's lower back, as this is illustrated by solid lines, as compared with the lumbar region support 6A illustrated in dashed lines according to prior art suggestions. Besides, the neck support 3A has been further pivoted in the opposite direction of the lowering direction of the chair back 2, so as to constitute a steeper support for the user's head or neck in this lying position, so that the latter can comfortably read or watch TV.

For the sake of simplification FIGS. 1–3 do not include a further feature of the invention, namely the possibility of releasing the pivoting mechanism of the neck support 3, so as to bring the neck support 3 back to a position as illustrated in FIG. 1, i.e. a released position. Further, it has not been illustrated in FIGS. 1–3 the further feature of the present invention which allows for a pre-adjustment of the neck support in relation to the associated chair back 2.

Figure 4:
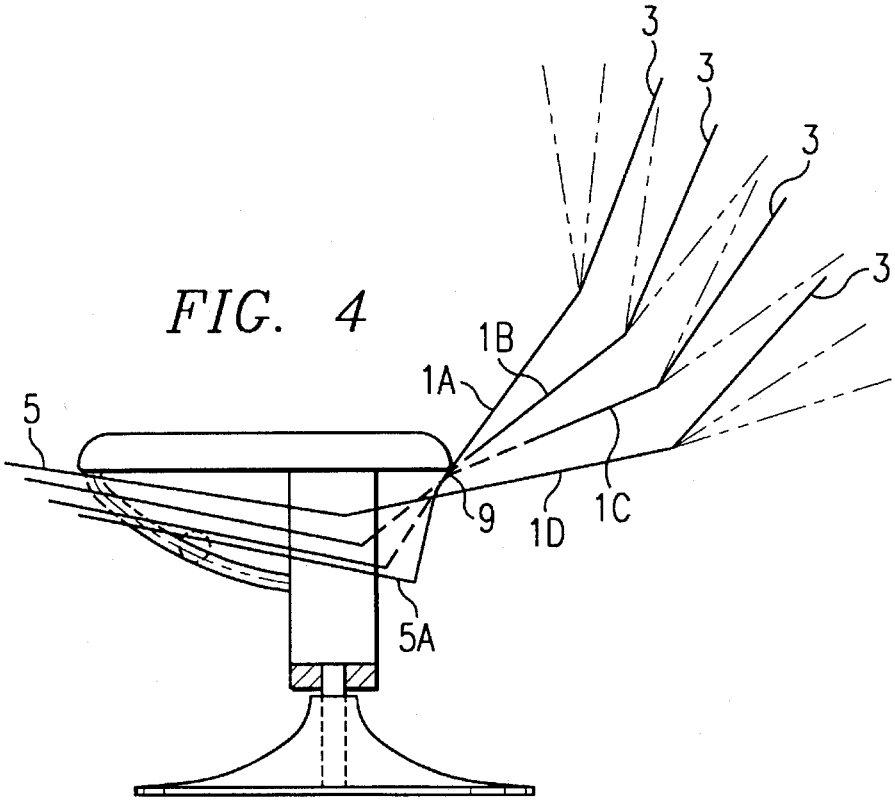
FIG. 4 illustrates with solid lines a chair of simple embodiment, whereas the dashed lines illustrate the additional features of regulating the neck support.

However, this broader aspect of the invention is illustrated in FIG. 4 in which it with solid lines are illustrated four different recline positions 1A, 1B, 1C and 1D, respectively, and wherein the dashed lines for each position illustrate the additional possibilities of adjusting the neck support 3, either by a manual pre-adjustment at any position or as an after-adjustment when this is required by the user to obtain optimum comfort.

In the following there will be given a detailed description of an embodiment of a recline chair according to the present invention, and this embodiment will provide important properties of such chairs, namely a good sitting comfort and the possibility of finding a plurality of various resting positions for the user. Such recline chairs should be easy to readjust, and since a plurality of such recline chairs can be readjusted just by the weight of the user, i.e. when the chair has not been locked in a specific position, involves that the user very often shifts position between an erect sitting position and any slanted resting position. In this connection it is very important for the comfort of the user that the user's lower back has a "correct" support in any of these sitting or resting positions.

In its vertical position the spine takes the natural shape of an "S", which calls for a protrusion for supporting the lumbar region thereof, as well as for a protrusion supporting the neck. Or oppositely, there is required a recess in the area of the user's buttocks and shoulder area.

When the user is lying on his back, a comfortable position for the spine would be an approximately straight position thereof. In order to compensate for this various requirement for lumbar region support in prior art recline chairs, it is usual to provide a cushioning shape which is ideal when the chair back is in an intermediate incline position, that is somewhat rearwardly inclined, which is the most commonly used position.

Another prior art solution for providing a varying lumbar region support is to use a soft cushioning material, such that the lumbar region due to compression of the cushioning material during use will take a straighter shape in lying position than in sitting position. However, the users of such embodiments often complain that the lumbar region support is too soft or weak when using the chair in upright position, and too pronounced when using the chair in a fully lowered position. They also complain about the size of the neck support or the neck pillow which feels too large and too advanced in the erected position of the chair, and which feels too small in the fully lowered position, especially when the user is to watch TV or read.

As indicated above under the heading "prior art" there are previously known solutions for altering the shape of the chair back, including manually operated systems through which the user by means of various control means can change the position of the neck support or the lumbar region support according to his own wish. In connection with such solutions the user of such chairs is enfaced with the disadvantage that upon alternation of the inclination of the chair back there arises a need for another adjustment of the lumbar region support.

Further, the prior art also discloses a plurality of solutions giving an automatic alteration of the shape of the chair back in dependence of the chair back inclination, but such automatic means are associated with chairs in which the chair seat has no horizontal movement when an alteration of the chair back inclination is effected. Usually the pivoting axis for chair backs in such types of chairs are positioned at the rear portion of the chair seat.

Said prior art solutions can be appropriate in chairs without arm rests, but in chair where arm rests are included, the user is enfaced with the disadvantage that the chair back in fully lowered position will give a very unfavourable position related to any arm rests.

In the following embodiment of a recline chair according to the invention, the shape of the chair back, especially in the area providing support for the user's lower back, will be changed or adjusted in dependence of the inclination of the chair back, such that the chair back renders a pronounced support for the lumbar region of the user when the chair is in an upright position, which lumbar region support will be gradually decreased as the chair back is inclined more and more towards an approximately horizontal position.

Figure 5B:
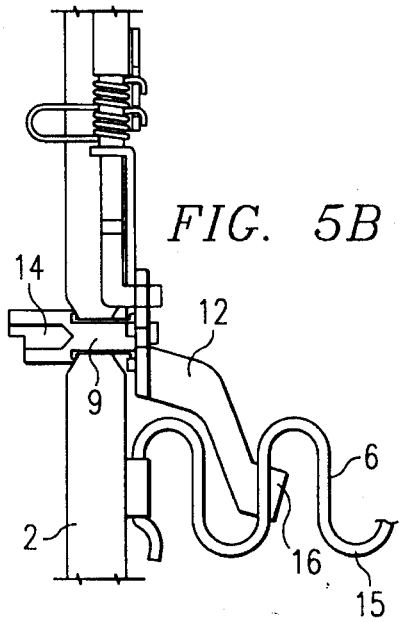
FIG. 5B is a schematic view as seen from above on a larger scale of an area of the support for the user's lower back.
Figure 5D:
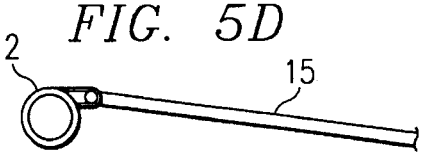
FIGS. 5C and FIG. 5D are partial schematic views of the details of the chair in FIGS. 5A and 5B.
Figure 5C:
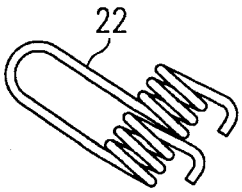
Figure 5A:
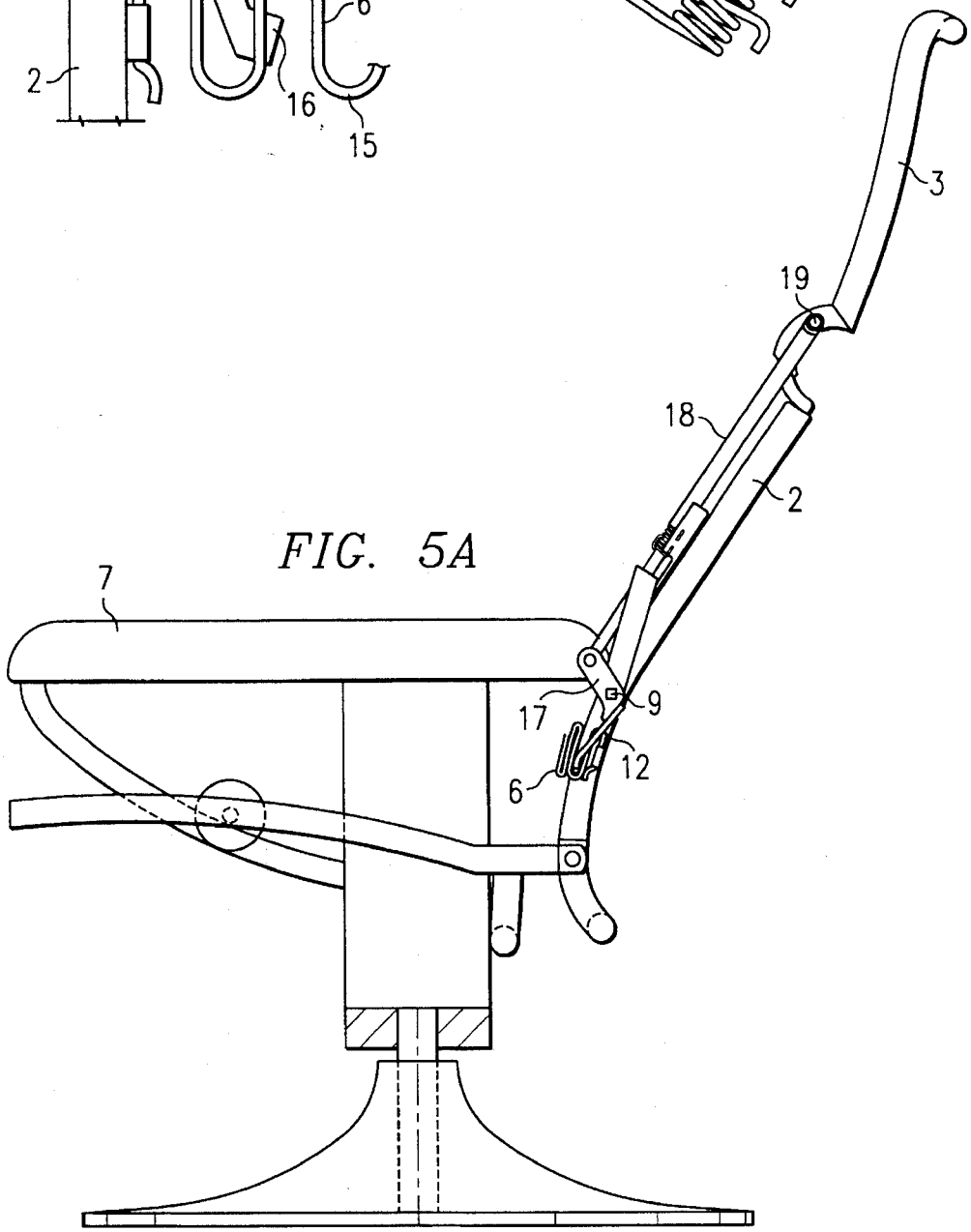
FIG. 5A is a schematic side view of the main features of an embodiment of a chair according to the present invention, here illustrated in erected position.

As appearing from FIG. 5A and FIG. 5B there is on each side of the chair back 2 provided an element 12 which is fixedly mounted in relation to said chair back 2, namely in relation to the frame 4 (see FIG. 3), but in the vicinity of the pivoting axis 9 of said chair back 2.

The element 12 will thus during the assembly of the chair 1 have its central area mounted stationary in relation to the arm rest 7 of the chair 1. However, the angular position of the element 12 in relation to the pivoting axis 9 or the frame of the chair back 2 is decided during the mounting thereof, and this angular position will determine how pronounced the support for the user's lower back should be, especially when the chair back 2 is in erected position. Further, it is to be understood that in a specific embodiment of the arrangement according to the present invention there is included an adjustment means 14 for appropriate adjustment of said angular position of said element 12.

Consequently, the selection of the angular position of said element 12 is decisive of whether the lumbar region support 6 should be more or less pronounced, and in the present embodiment this angular position of the elements 2 will also be decisive as to whether the neck support 3 should be more or less pronounced or retracted in the various positions of the chair back 2. In the present embodiment the angular position of the element 12 regulating the support of the user's lower back 6 will also influence the inclination of the neck support 3 through a mechanism which will be disclosed in detail in the following.

As illustrated especially in FIG. 5B, the element 12 comprises an end portion 16 extending downwardly and inwardly from the pivoting point 9 of the chair back 2 or chair back frame 2, which end portion 16 is located below the pivoting axis 9 of the element 12, so as to be in touch or in contact with the springs 15 or any other appropriate element constituting the lumbar region support 6 in dependence of the inclination of the chair back 2. The springs 15 will thus be pressed forwardly or biased very much to constitute a pronounced support for the user's lower back when the chair back 2 is in erected position, whereas said springs 15 will be removed from said element 12 and thereby constitute a less pronounced lumbar support when the chair back 2 is taking a more rearwardly inclined position. In the present embodiment there are chosen springs 15 as lumbar region support 6, but in other cases it should be understood that other appropriately stiff elements could possibly be used.

Figure 6:
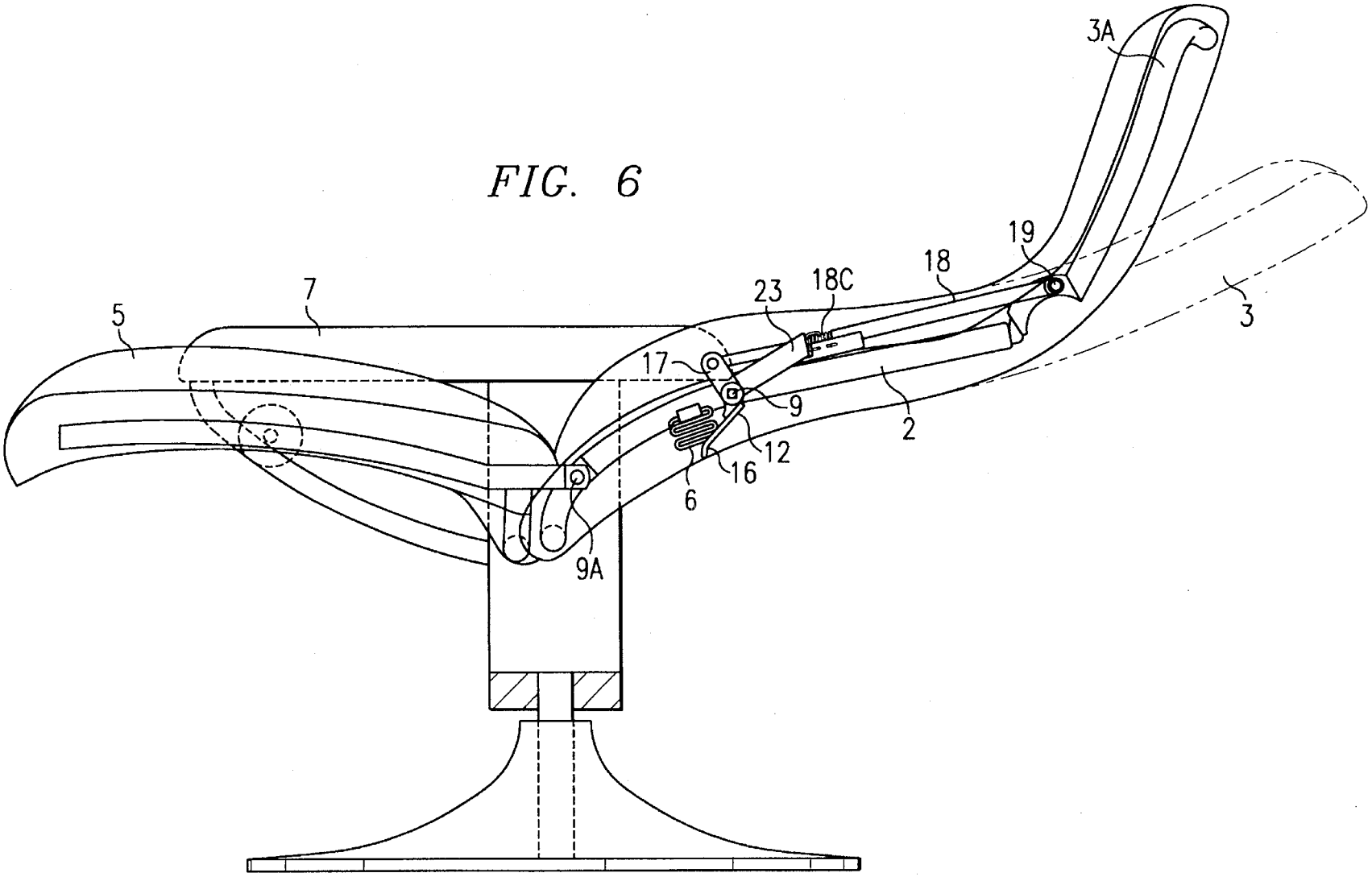
FIG. 6 is a schematic side view similarly to FIG. 5A, but with the chair in a lowered position and illustrating on a larger scale further details of the corresponding regulating mechanism.

As appearing from FIG. 5A and FIG. 6, the element 12 also comprises a second end portion 17 which is located above the pivoting axis 9 of said chair back 2, and which is connected to a pulling rod 18 through an appropriate link. The pulling rod 18 extends along the chair back 2 and is at its upper end provided with a link connection 19 attached to the lower end of the neck support 3 and 3A.

The length of the pulling rod 18 and the location of the lower link 17 and the upper link 19 thereof is chosen so that the neck support 3 can take an angular position in relation to the chair back 2 which represents an approximate "normal position" both in erected and lowered position of said chair back 2.

As illustrated in FIG. 6 and especially in FIGS. 7A, 7B, and 8 the pulling rod 18 can be provided with means allowing for a length variation of said pulling rod 18 as well as a locking of any appropriate length thereof anywhere within extreme limits which can be included in such additional means.

The adjustable pulling rod 18 comprises a pipe 18*a* which is pivotally mounted in said link 19. An extension 18*b* of said pipe 18*a* made of profile iron constitutes a bracket for a spring 22 and is at the end portion shaped as a stopper against an element 23 for thereby physically limiting the maximum length of said pulling rod 18.

The pulling rod 18 also comprises a shaft 21 which is pivotally mounted through the upper end portion 17 of said element 12 and extends through said spring 22, such that the shaft 21 and the helical portion 22B of said spring 12 have a common center line, said shaft 21 also passing through said pipe 18*a* for together with the latter to constitute a guiding means. Said spring 22 has been given a diameter which is very much smaller than the diameter of said shaft 22, which means that the helical portion 22*b* of said spring 22 will exercise a necessary holding force for being attached to said shaft 21.

In order to reduce the possibility of any twisting, there is in the present embodiment chosen a double spring made from steel wire, but also a simple spring will principally give the same function. Appropriately, the helical portion 22A of said spring may have a space between each turn.

This type of spring 22, 22*a* will have the following properties. By exercising a pressure on the free ends 22*a* of said spring 22, namely transversally to the center line of the shaft 21, a pressure in direction away from said shaft 21 will reduce the gripping force against said shaft and said spring 22 will consequently be loosened. Oppositely, if pressure is exercized in direction towards said shaft 21, the gripping power of said spring 22 will be increased. Correspondingly, by exercizing a pressure in axial direction towards said spring 22, 22*b*, the spaces between the turns of the helical portion 22*b* will decrease and the fastening grip thereof will loosen, whereas a pressure on the spring 22 in a direction opening at said spaces between the spring turns will increase the gripping function thereof.

In the illustrated embodiment the free ends 22*c* of the helical spring 22*a* is threaded through holes in the extension 18*b* of the pipe 18*a* for thereby constituting a so to say affixed connection with the pipe 18*a* and the extension 18*b*, but with some clearance therebetween.

Said free end 22*a* of the springs 22 are in this embodiment shaped and located such that they can be passed out through the cushioning and the cover of the chair back 2, for thereby constituting an operating means which can be operated by the user for changing the length of the pulling rod 18, and thereby the angular position of the neck support 3. Individual positioning of the neck support 3 can be chosen by the user of the chair 1 by pushing the spring 22 rearwardly, for example by means of his elbow, whereby the gripping function of said spring 22 is released and whereby the neck support 3 can be shifted to a desired position. The extreme outer positions of the neck support 3 is decided through mechanical end stops. When said neck support 3 is shifted to an end stop, but when the chair back 2 is away from any end stop position, then the helical portion 22*b* of said spring 22 will abut against either the end portion 18*c* of said pipe 18*a* or against the end of said previously mentioned element 23 depending on whether the seat back 2 is shifted towards an erected or towards a lowered position. The following compression of the helical spring 22*b* will release said spring from the shaft 21, and the chair back 2 can be shifted towards its extreme position, and at the same time the neck rest or neck support 3 will take the corresponding extreme outer position. In the present embodiment the neck support 3 will return to its "normal position" each time the chair back 2 arrive at an extreme outer position, independent of how the user previously has set neck support.

In FIGS. 9A–E it is illustrated how the chair frame 2 is provided with a bearing means 27 around which the chair back 2 can be pivoted. The bearing means 27 comprises a bolt 24 in which a first end constitutes a fixed connection with said lumbar region support element 12, for example through a square washer. The second end of said bolt 24 comprises an axial bore 24*a* provided with threads and a tapped end surface fitting together with the end of a sleeve 34. The sleeve 34 has an axial bore corresponding to the bolt 24, i.e. having a diameter fitting to the non-threaded portion of said bolt 24.

By assembling the sleeve 34 and the bolt 24 in connection with a screw 35, there is provided a fixed and directionally decided connection between the arm rests 7 and said sleeve 34, said bolt 24 and said lumbar back region supporting element 12. This assembly is designed to transfer the necessary forces for changing the position of the chair back.

It should be noted that in a second embodiment which allows for any wanted adjustment of lumbar region support, the sleeve 34 can be attached to the arm rest 7, such that said sleeve 34 could be turned around its longitudinal axis in relation to said arm rest 7 by means of an appropriate adjustment device.

The end of said sleeve 34 having a threaded portion can extend through the cushioning of the chair and the cover thereof, such that the assembly of the chair back is simplified.

Further, it should be noted that all the elements of the chair back can be designed and pre-mounted in such a manner that a complete chair back frame included all its functions can be moulded into a foam cushioning.

Figure 9D:
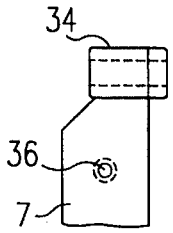
FIGS. 9A, 9B, 9C, 9D and 9E illustrate further details of the regulating mechanism, especially as regards the pre-adjustment of the support for the user's lower back.
Figure 9E:
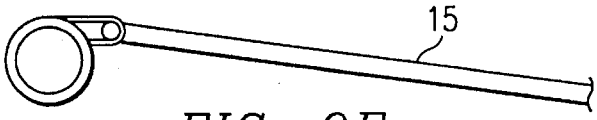
Figure 9A:
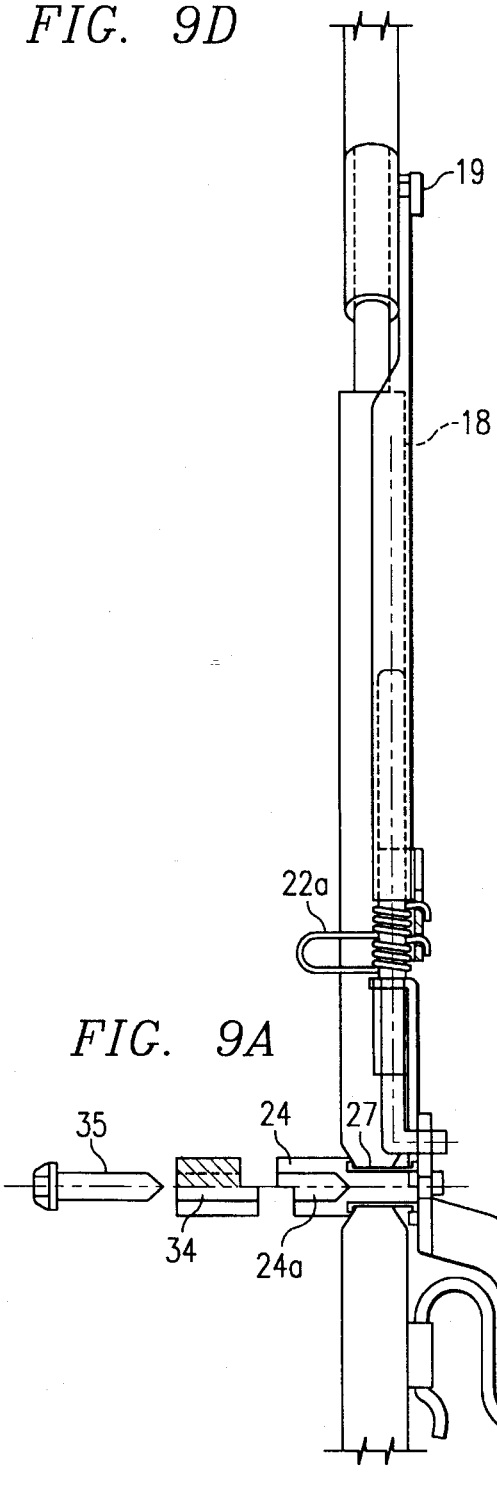
Figure 9B:
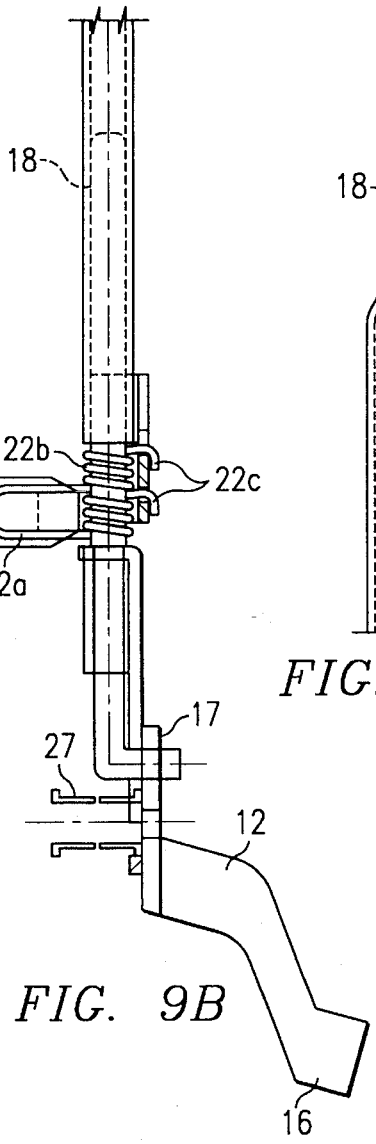
Figure 9C:
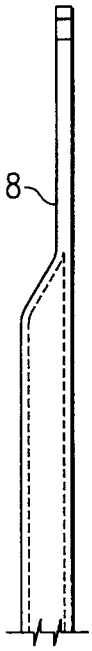

In FIG. 9D it is illustrated a mounting hole 36 for the cushioning cover of the arm rest 7.

FIGS. 10A–D and 11A–C illustrate both the chair back 2 having the same slanting position, but with the neck support 3 in their two extreme positions, respectively. In FIGS. 10A–D there is indicated that the stopping abutment for the neck support 3 can be moved between said element 23 and said extension 18*b* of the pipe 18.

Figure 11C:
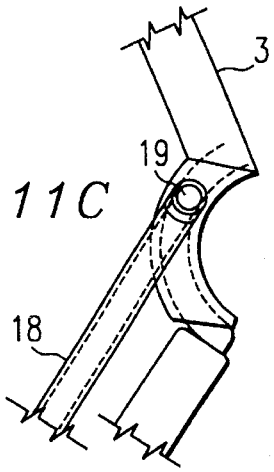
Figure 11B:
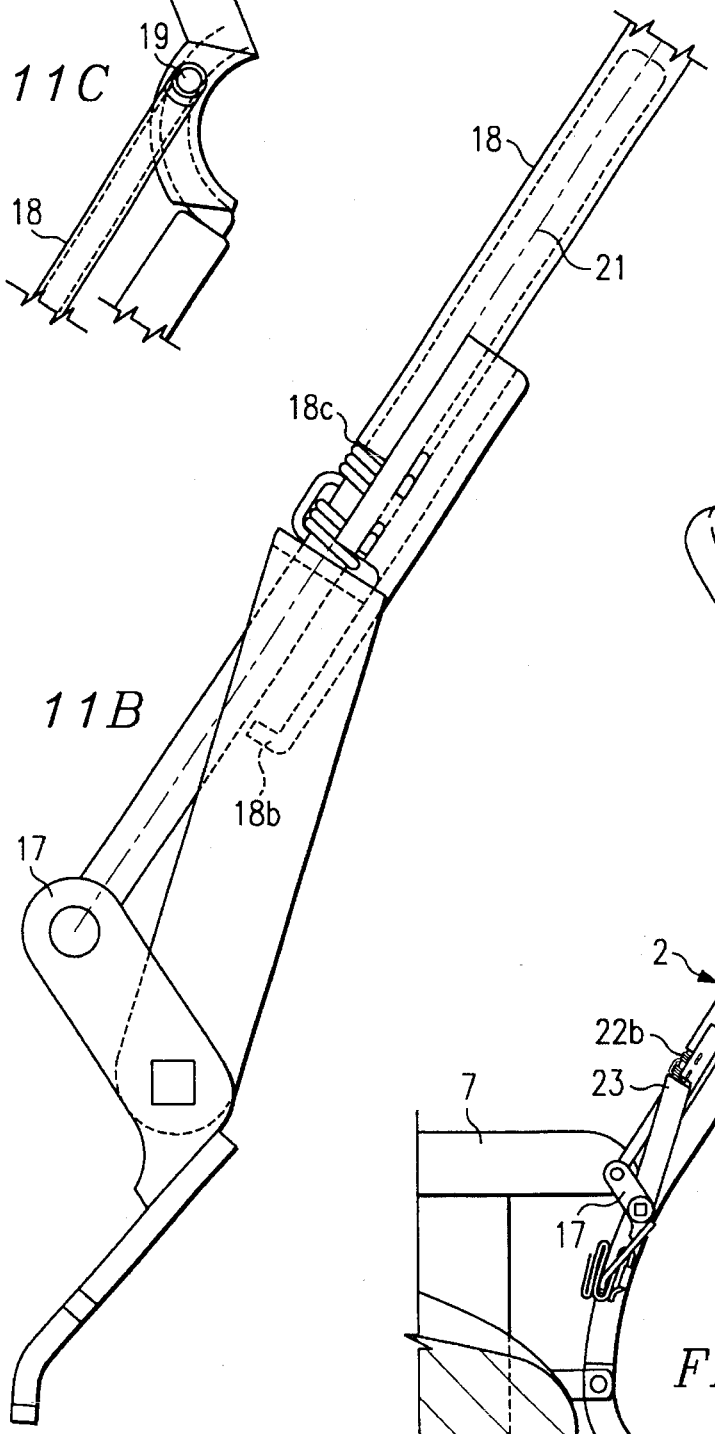
Figure 11A:
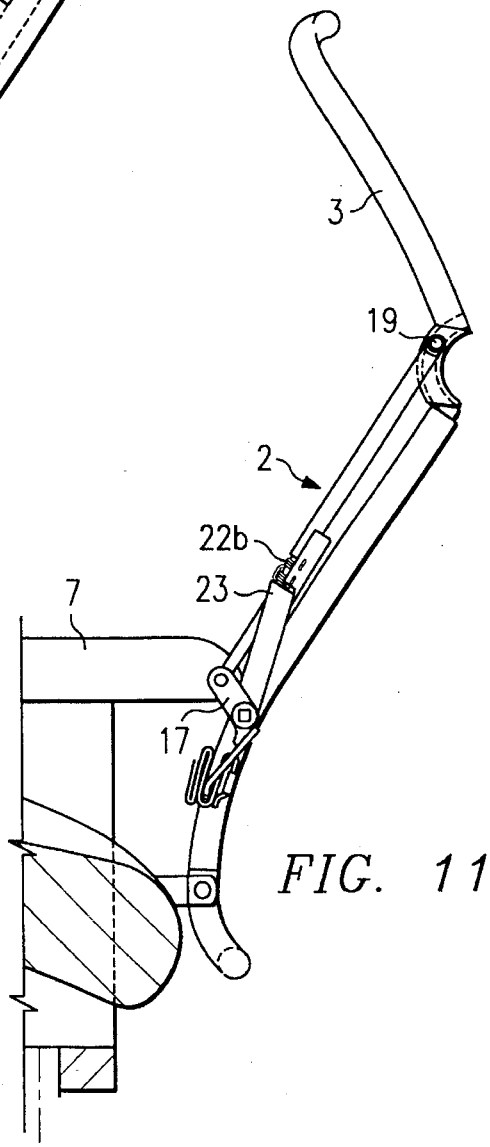

FIGS. 11A–C illustrate the limitation of the movement of the neck rest 3 is provided by the element 23 abutting against the end portion 18*c* of the pipe 18*a*, whereas the spring 22*b* is positioning therebetween as an intermediate element.

The end surface of the element 23 is provided with a bore through which the shaft 23 can extend freely. This will ensure that the stopper is kept in correct position.

FIGS. 12A–C illustrate the chair back 2 in its fully lowered position, and with the neck support 3 in same position as stated in FIG. 11A, and with the lumbar region support 6 in fully retracted position.

As disclosed above, the present arrangement provides a recline chair in which the means for influencing the shape of the chair back are adapted for giving a pronounced support for the user's lower back when the chair back is in an erected sitting position, whereas said means render a gradually decreasing support of the user's lower back when said chair back is lowered rearwardly toward a lying position.

It has been found that three particular fields of application for such recline chairs put up various requirements as to the adjustment of the neck support in relation to the inclination of the chair back. The watching of TV requires the largest movements. Reading and the use of the chair as a normal sitting chair requires an intermediate position which is called "normal position" involving a slight adjustment of the angular position of the neck rest relation to the associated chair back position. The resting position or the lying position requires almost the same angular position of the neck rest as the upright position of the chair.

The present chair arrangement allows for manual alteration of the adjustment of neck rest for adapting to TV watching, reading or resting, including automatic reestablishing of the normal position thereof.

The above embodiment has been disclosed in connection with a chair, wherein the chair back pivots about an axis extending horizontally through said chair back, or somewhat below the height of the elbow of the user. When the chair back of such chairs are inclined rearwardly, the rear portion 5A of the seat will be moved along a circular path having its center in the pivoting axis 9 of the chair back 2.

An advantage related thereto is that the arm rests 7 are always in a comfortable position.

In chairs having a high chair back, the upper portion of the back will be shaped as a neck rest, and when design requirements do not include a partition between the chair back and the neck support, one will be enfaced with the problem slackening and tensioning of the cover when the position of the neck rest is altered in relation to the chair back.

However, in the present arrangement due attention can be taken when designing the cushioning and cover.

On the rear side of the chair back it is often desired to have a plain surface without wrinkles and pleats, and if usual hinges in connection with the connection between the chair back and the neck rest is chosen, this will involve that the pivoting axis of the neck support will be positioned at a distance from the rear cover when the frame is to be hidden by the cover, and this distance may be of large value, a fact which can be amplified when an arced rear chair back is wanted.

In order to avoid the usual tensioning and slackening of the cover there should according to the present invention be used a circular guiding instead of a hinge. This will give a theoretic pivoting axis in the connection between a chair back and neck rest which can be positioned so far behind the chair back frame that the tightening and slackening of the cover is reduced to a minimum.

In summary, it can be said that the present invention finds particular application in connection with a recline chair in which the chair back can be pivoted about an axis positioned close to the arm rest.

The adjusting mechanism can thereby be associated with the movement of the arm rests.

Further, the present arrangement provides for a directional connection between chair back and suspension of the chair back, i.e. between the sleeve 34 and the mounting bolt 24.

The present invention also provides for an adjustment device in connection with the arm rests for providing a pronounced support for the user's lower back and a gradually reducing support when the chair back is lowered.

The length of the pulling rod between the chair frame and the neck rest can be varied, and provide for individual adjustment of the neck rest.

The regulating mechanism for the length of the pulling rod also provides for automatic return of the neck rest after manual regulation.

The arc-shaped guiding providing for connection between the neck support and the chair frame renders a possibility for a pivoting point having its theoretical center outside the chair back.

We claim:

1. Arrangement in a recline chair, including a chair back (2) adjustable in relationship to a chair seat (5), and a neck support (3), said chair back (2) being mounted to pivot around a horizontal, stationary axis (9) in relation to a chair frame (4) and at a lower end of said chair back (2) being hinged to the chair seat (5) through a connection link (9A) so that various inclined positions of the chair back (2) about the axis (9) will shift the chair seat (5) back and forth in relation to the chair frame (4) via a chair seat sliding mechanism (8), said chair back (2) also comprising appropriately resilient elements (15) mounted behind cushioning of the chair back (2) and constituting a lumbar region support (6), characterized in that the arrangement comprises influencing means (12) arranged stationary in the area of said axis (9) and inside the cushioning of said chair back (2), said influencing means comprising an end portion (16) extending downwardly and inwardly from the axis (9) of the chair back (2) so as to be in contact with said resilient elements (15) constituting the lumbar region support (6) of the chair back (2) in dependence of the inclination of the chair back (2), said resilient elements (15) thus being pressed forwardly by said downwardly extending end portion (16) to constitute a pronounced support for the user's lower back when the chair back (2) is in erected position and said chair seat (5) retracted closer to said axis (9), whereas said resilient elements (15) will be removed from said end portion of said influencing means (12) and thereby constitute a less pronounced lumbar support when the chair back (2) is in a more rearwardly inclined position and said chair seat (5) is displaced further away from said axis (9).

2. Arrangement as claimed in claim 1 characterized in that the influencing means (12) influencing the shape of the lumbar region support (6) of the chair back (2), depends on the inclination of the chair back (2) relative to stationary arm rests (7) of the chair (1).

3. Arrangement as claimed in claim 1, characterized in that it comprises a bearing (27) in which the chair back (2) can pivot, said bearing (27) holding a bolt means (24) which at the one end is fixedly connected to the influencing means (12), whereas the opposite end of said bolt means (24) comprises an axial bore provided with threads and a tapped end surface (**24*a*) as well as a regulating means (34) adapted to the tapped end surface (24*a*) of said bolt means (24) and being screwed thereonto by means of a bolt (35**).

4. Arrangement as claimed in claim 1, characterized in that said influencing means (12) is adapted to be pre-adjusted around said axis (9) for thereby regulating the most pronounced lumbar region support in the upright position of the chair back (2).

5. Arrangement as claimed in claim 1 or 4, characterized in that said resilient elements (15) are arranged transversely between side frames of the chair back (2) and attached to said side frames by suspension points such that the suspension points thereof are influenced by the stationary end portion (16), respectively, of said influencing means (12) depending on the angular position of the chair back (2), said suspension points of the resilient elements (15) being pressed forwardly by said influencing means for thereby giving a more pronounced but resilient lumbar region support (6) for the user's lower back when the chair back (2) is in erected position, whereas said resilient elements (15) render a gradually decreasing but resilient lumbar region support (6) for the user's lower back when said chair back is lowered rearwardly towards a laying position, by being brought out of a biasing range of said influencing means (12) which thereby releases its forwardly pressing influence thereon.

6. Arrangement as claimed in claim 5, characterized in that the influencing means (12) influencing the shape of the resilient lumbar region support (6) of the chair back (2), depends on the inclination of the chair back (2) relative to stationary arm rests (7) of the chair (1).

7. Arrangement as claimed in claim 1, characterized in that said neck support (3) is adjustable in relation to the relative inclined positions of the chair back (2), said neck support (3) comprising an arced guide (29) located in a rear portion of the chair back (2) so as to reduce tightening and slackening of a chair cover in the area of said neck support (3).

8. Arrangement as claimed in claim 7, characterized in that the influencing means (12) is so connected to the neck support (3) that by pre-adjusting the influencing means (12) for pronounced lumbar region support, the neck support (3) will take a more rearwardly directed position, whereas with a less pronounced lumbar region support preset by the influencing means (12) there is allowed for a more forwardly inclined position of the neck support (3).

9. Arrangement as claimed in claim 7 characterized in that between the influencing means (12) and the neck support (3) there is provided a rod (18), the length thereof and the location of an upper attachment point (19) to the neck support (3) and a lower attachment point (17) being so adapted that the neck support (3) can take an approximate normal position both in raised and lowered positions of the chair back (2).

10. Arrangement as claimed in claim 9, characterized in that the rod (18) comprises regulating means (18*a*, 18*b*, 21) as well as locking means (22, 22*a* , 22*b*) for adjusting the length of said rod (18) and thereby an inclined position of the neck support (3) in relation to the chair back (2).

11. Arrangement as claimed in claim 10, characterized in that the rod (18) comprises a shaft (21) which can be guided in a pipe (18*a*), and that in a transition between the pipe (18*a*) and the shaft (21) there is provided an operable locking means (22, 22*a*, 22*b*) which in uninfluenced condition locks the shaft (21) and the pipe (18*a*) in relation to each other for thereby giving the rod (18) a pre-determined length, but which upon operation releases the locking effect and allows for an alternation of the length of the rod (18), and thereby the inclined position of the neck support (3) in relation to the chair back (2).

12. Arrangement as claimed in claim 10 characterized in that the locking means (22, 22*a*, 22*b*) is adapted so as to enable locking of the neck support (3) between end stoppers (18*c*, 23) independent of the more erected position of the chair back (2).

13. Arrangement as claimed in claim 10, characterized in that the locking means (22, 22*a*, 22*b*) is adapted so that upon a shifting of the chair back (2) towards an extreme position without the neck support (3) in the corresponding extreme position, the movement of the chair back (2) will influence the locking means (22, 22*a*, 22*b*) with the corresponding end stopper (18*c*, 23) to release the locking means (22, 22*a*, 22*b*), such that the chair back (2) and the neck support (3) move simultaneously towards the respective corresponding extreme position.

14. Arrangement as claimed in claim 13, characterized in that it comprises a bearing (27) in which the chair back (2) can pivot, said bearing (27) holding a bolt means (24) which at one end is fixedly connected to the influencing means (12), whereas the opposite end of said bolt means (24) comprises an axial bore provided with threads and a tapped end surface (24*a*) as well as a regulating means (34) adapted to the tapped end surface (24*a*) of said bolt means (24) and being screwed thereonto by means of a bolt (35).

* * * * *